US006397034B1

(12) United States Patent
Tarnawskyj et al.

(10) Patent No.: US 6,397,034 B1
(45) Date of Patent: May 28, 2002

(54) FLUORINATED CARBON FILLED POLYIMIDE INTERMEDIATE TRANSFER COMPONENTS

(75) Inventors: Ihor W. Tarnawskyj, Webster; Joseph Mammino, Penfield; Frederick E. Knier, Jr., Wolcott; Kock-Yee Law, Penfield; Martin A. Abkowitz, Webster; Robert M. Ferguson, Penfield, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 08/921,133

(22) Filed: Aug. 29, 1997

(51) Int. Cl.[7] ..... G03G 15/14; G03G 15/16
(52) U.S. Cl. ..... 399/308; 399/302
(58) Field of Search ..... 399/297, 302, 399/303, 308, 309

(56) References Cited

U.S. PATENT DOCUMENTS

| | | | | | |
|---|---|---|---|---|---|
| 3,893,761 | A | * | 7/1975 | Buchan et al. | 399/308 |
| 4,546,892 | A | | 10/1985 | Couput | 215/252 |
| 4,831,977 | A | | 5/1989 | Presswood | 123/193 |
| 5,000,875 | A | | 3/1991 | Kolouch | 252/511 |
| 5,017,223 | A | | 5/1991 | Kobayashi | 106/20 |
| 5,037,587 | A | | 8/1991 | Saruwatari et al. | 264/22 |
| 5,112,708 | A | | 5/1992 | Okunuki | 430/31 |
| 5,230,818 | A | | 7/1993 | James et al. | 252/62.55 |
| 5,337,129 | A | * | 8/1994 | Badesha | 399/308 |
| 5,397,863 | A | | 3/1995 | Afzali-Ardakani et al. | 174/258 |
| 5,448,419 | A | | 9/1995 | Bigelow et al. | 360/17 |
| 5,537,194 | A | * | 7/1996 | Henry et al. | 399/308 |
| 5,556,899 | A | * | 9/1996 | Afzali-Ardakani et al. | 523/215 |
| 5,571,852 | A | | 11/1996 | Afzali-Ardakani et al. | 523/215 |
| 5,576,818 | A | * | 11/1996 | Badesha et al. | 399/308 |
| 5,585,905 | A | * | 12/1996 | Mammino et al. | 399/308 |
| 5,591,285 | A | | 1/1997 | Afzali-Ardakani et al. | 156/62.2 |
| 5,618,647 | A | | 4/1997 | Kukimoto | 430/106.6 |
| 5,745,830 | A | * | 4/1998 | Fujiwara et al. | 399/308 |
| 5,761,595 | A | * | 6/1998 | Tarnawskyj et al. | 399/308 |
| 5,802,442 | A | * | 9/1998 | Konno et al. | 399/308 |
| 5,849,399 | A | * | 12/1998 | Law et al. | 430/126 X |
| 5,873,018 | A | * | 2/1999 | Aoto et al. | 399/302 |

FOREIGN PATENT DOCUMENTS

| | | | |
|---|---|---|---|
| JP | 59-77467 | * | 5/1984 |
| JP | 7-225511 | * | 8/1995 |

OTHER PUBLICATIONS

Patent Abstract of Japan, vol. 013, No. 149 (p–855), Apr. 12, 1989, entitled Intermediate Transfer Body, by Kobayashi Hiroaki.

Patent Abstract of Japan, vol. 008, No. 188 (p–297), Aug. 29, 1984, entitled Recording Device, by Ito Kunio.

* cited by examiner

*Primary Examiner*—Fred L Braun
(74) *Attorney, Agent, or Firm*—Annette L. Bade

(57) ABSTRACT

An intermediate transfer member having a fluorinated carbon filled polyimide layer which exhibits controlled conductivity is set forth, and in embodiments, the fluorinated carbon filled polyimide layer is a substrate having an optional intermediate conformable layer thereon, and having on the intermediate layer, an optional outer release layer.

21 Claims, 3 Drawing Sheets

FLUORINATED CARBON FILLED POLYIMIDE INTERMEDIATE TRANSFER COMPONENTS

Attention is directed to application U.S. patent application Ser. No. 08/920,809, filed Aug. 29, 1997, now U.S. Pat. No. 6,066,408, entitled, "Polyimide Biasable Components." The disclosure of this application is hereby incorporated by reference in its entirety.

BACKGROUND OF THE INVENTION

The present invention relates to intermediate transfer members, and more specifically, to intermediate transfer members useful in transferring a developed image in an electrostatographic, especially xerographic, including digital, machine or apparatus. In embodiments of the present invention, there are selected intermediate transfer members comprising a layer or substrate comprising a filled polymer, preferably a filled polyimide, and particularly preferred a fluorinated carbon filled polyimide. In embodiments, the present invention allows for the preparation and manufacture of intermediate transfer members with excellent electrical, chemical and mechanical properties, including controlled resistivity in a desired resistivity range and excellent conformability. Moreover, the intermediate transfer members herein, in embodiments, allow for high transfer efficiencies to and from intermediates even for full color images and can be useful in both dry and liquid toner development systems.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Generally, the electrostatic latent image is developed by bringing a developer mixture into contact therewith. The developer mixture can comprise a dry developer mixture which usually comprises carrier granules having toner particles adhering triboelectrically thereto, or a liquid developer material which may include a liquid carrier having toner particles dispersed therein. The developer material is advanced into contact with the electrostatic latent image and the toner particles are deposited thereon in image configuration. Subsequently, the developed image is transferred to a copy sheet. It is advantageous to transfer the developed image to a coated intermediate transfer web, belt or component, and subsequently transfer with very high transfer efficiency the developed image from the intermediate transfer member to a permanent substrate. The toner image is subsequently usually fixed or fused upon a support which may be the photosensitive member itself or other support sheet such as plain paper.

In electrostatographic printing machines wherein the toner image is electrostatically transferred by a potential between the imaging member and the intermediate transfer member, the transfer of the toner particles to the intermediate transfer member and the retention thereof should be as complete as possible so that the image ultimately transferred to the image receiving substrate will have a high resolution. Substantially 100% toner transfer occurs when most or all of the toner particles comprising the image are transferred and little residual toner remains on the surface from which the image was transferred.

Intermediate transfer members allow for positive attributes such as enabling high throughput at modest process speeds, improving registration of the final color toner image in color systems using synchronous development of one or more component colors using one or more transfer stations, and increasing the range of final substrates that can be used. However, a disadvantage of using an intermediate transfer member is that a plurality of transfer steps is required allowing for the possibility of charge exchange occurring between toner particles and the transfer member which ultimately can lead to less than complete toner transfer. The result is low resolution images on the image receiving substrate and image deterioration. When the image is in color, the image can additionally suffer from color shifting and color deterioration. In addition, the incorporation of charging agents in liquid developers, although providing acceptable quality images and acceptable resolution due to improved charging of the toner, can exacerbate the problem of charge exchange between the toner and the intermediate transfer member.

Preferably, the resistivity of the intermediate transfer member is within a preferred range to allow for sufficient transfer. It is also important that the intermediate transfer member have a controlled resistivity, wherein the resistivity is virtually unaffected by changes in humidity, temperature, bias field, and operating time. In addition, a controlled resistivity is important so that a bias field can be established for electrostatic transfer. It is important that the intermediate transfer member not be too conductive as air breakdown can possibly occur.

Attempts at controlling the resistivity of intermediate transfer members have been accomplished by, for example, adding conductive fillers such as ionic additives and/or carbon black to the outer layer. However, there are problems associated with the use of such additives. In particular, undissolved particles frequently bloom or migrate to the surface of the polymer and cause an imperfection in the polymer. This leads to nonuniform resistivity, which in turn, causes poor antistatic properties and poor mechanical strength. The ionic additives on the surface may interfere with toner release. Furthermore, bubbles may appear in the conductive polymer, some of which can only be seen with the aid of a microscope, others of which are large enough to be observed with the naked eye. These bubbles provide the same kind of difficulty as the undissolved particles in the polymer, namely poor or nonuniform electrical properties and poor mechanical properties.

In addition, the ionic additives themselves are sensitive to changes in temperature, humidity, and operating time. These sensitivities often limit the resistivity range. For example, the resistivity usually decreases by up to two orders of magnitude or more as the humidity increases from 20% to 80% relative humidity. This effect limits the operational or process latitude.

Moreover, ion transfer can also occur in these systems. The transfer of ions leads to charge exchanges and insufficient transfers, which in turn causes low image resolution and image deterioration, thereby adversely affecting the copy quality. In color systems, additional adverse results include color shifting and color deterioration. Ion transfer also increases the resistivity of the polymer member after repetitive use. This can limit the process and operational latitude and eventually the ion-filled polymer member will be unusable.

Carbon black particles can impart other specific adverse effects. These carbon dispersions are difficult to prepare due to carbon gelling, and the resulting layers may deform due to gelatin formation. This can lead to an adverse change in the conformability of the intermediate transfer member, which in turn, can lead to insufficient transfer and poor copy quality, and possible contamination of other machine parts and later copies.

Generally, carbon additives tend to control the resistivities. However, the required tolerance in the filler loading to achieve the required range of resistivity is extremely narrow. This, along with the large "batch to batch" variation, leads to the need for extremely tight resistivity control. In addition, carbon filled polymer surfaces have typically had very poor dielectric strength and sometimes significant resistivity dependence on applied fields. This leads to a compromise in the choice of centerline resistivity due to the variability in the electrical properties, which in turn, ultimately leads to a compromise in performance.

Therefore, there exists an overall need for an intermediate transfer member for use in both dry and liquid toner systems, which provides for increased toner transfer efficiency and a decrease in the occurrence of charge exchange. More specifically, there exists a specific need for an intermediate transfer member having controlled resistivity in a desired range to neutralize toner charges, thereby decreasing the occurrence of charge exchange, increasing image quality and preventing contamination of other xerographic members. In addition, there exists a specific need for an intermediate transfer member which has an outer surface having the qualities of a stable resistivity in the desired resistivity range and, in embodiments, has improved conformability and low surface energy properties of the release layer.

SUMMARY OF THE INVENTION

The present invention provides, in embodiments, an intermediate transfer member comprising a fluorinated carbon filled polyimide substrate.

The present invention further includes, in embodiments, an intermediate transfer belt for transferring a liquid image having at least a liquid carrier with toner or solid particles dispersed therein from a member to a substrate, comprising a fluorinated carbon filled polyimide substrate, and having thereon a fluoroelastomer intermediate layer, and positioned thereon an outer silicone rubber release layer.

In addition, the present invention provides, in embodiments, an apparatus for forming images on a recording medium comprising: a charge-retentive surface to receive an electrostatic latent image thereon; a development component to apply toner to said charge-retentive surface to develop said electrostatic latent image and to form a developed image on said charge retentive surface; an intermediate transfer member to transfer the developed image from said charge retentive surface to a substrate, wherein said intermediate transfer member comprises a fluorinated carbon filled polyimide layer; and a fixing component.

BRIEF DESCRIPTION OF THE DRAWINGS

For a better understanding of the present invention, reference may be had to the accompanying figures.

DETAILED DESCRIPTION OF THE INVENTION

The present invention relates to intermediate transfer systems comprising intermediate transfer members comprising a fluorinated carbon filled polyimide substrate.

Figure 1:
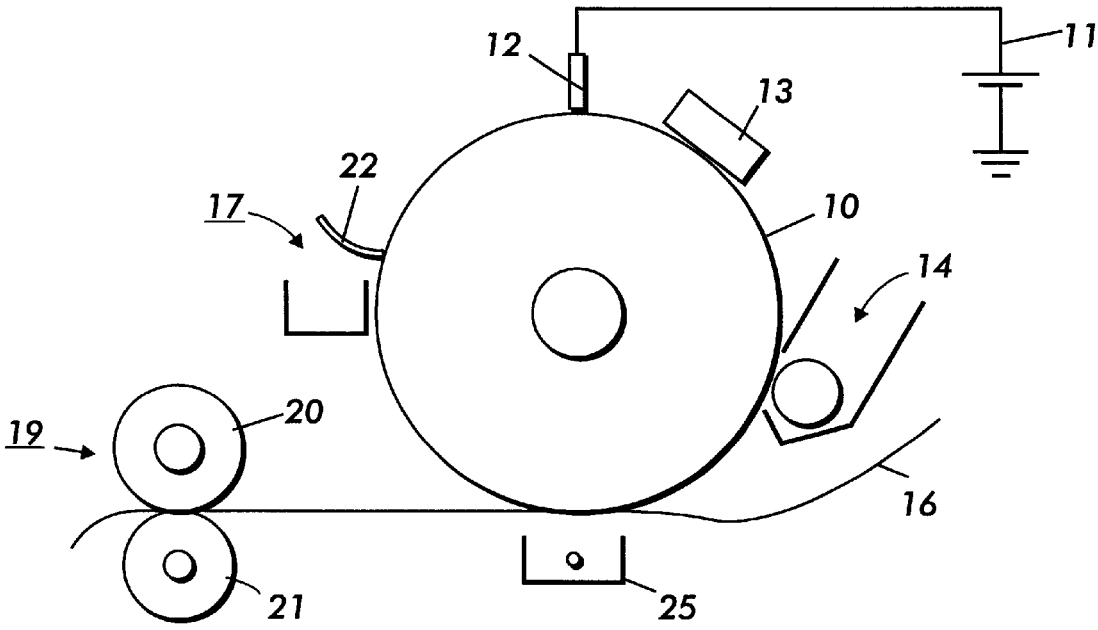
FIG. 1 an illustration of a general electrostatographic apparatus.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface, in image configuration, they are transferred to a copy sheet 16 by transfer means 25, which can be pressure transfer or electrostatic transfer. Alternatively, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Photoreceptor 10, subsequent to transfer, advances to cleaning station 17, wherein any toner left on photoreceptor 10 is cleaned therefrom by use of a blade 22 (as shown in FIG. 1), brush, or other cleaning apparatus.

Figure 2:
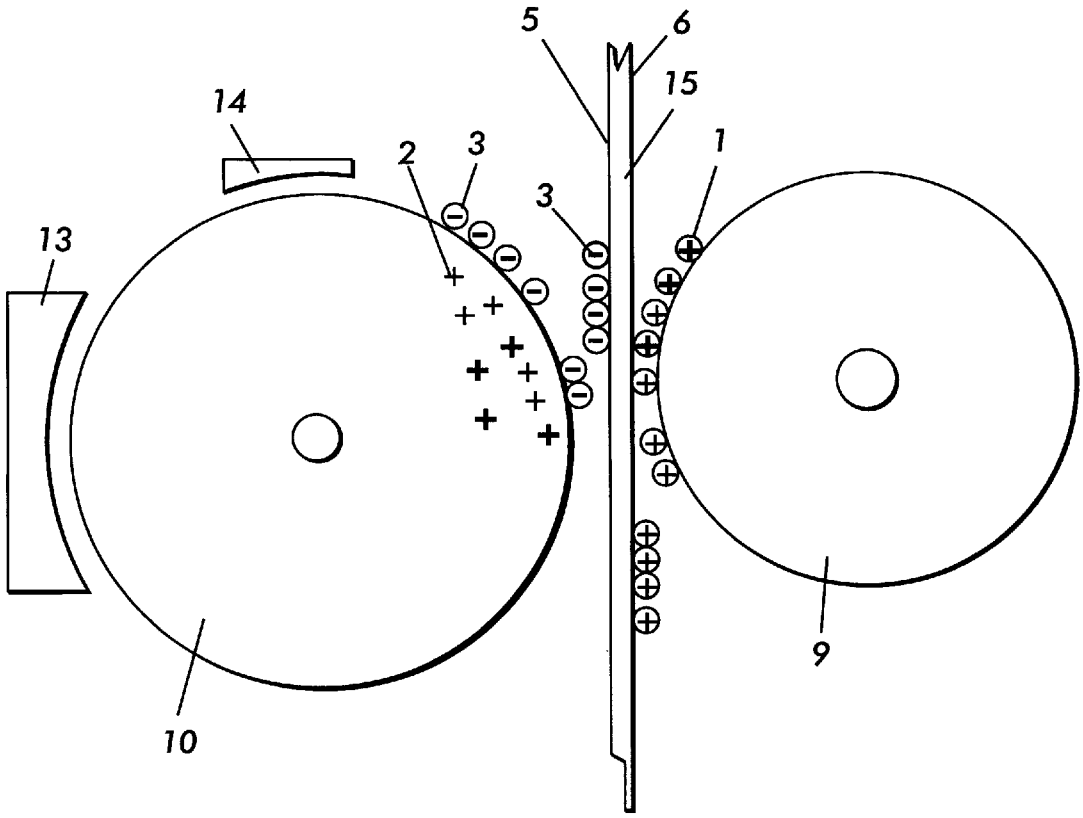
FIG. 2 is a schematic view of an image development system containing an intermediate transfer member.

FIG. 2 demonstrates an embodiment of the present invention and depicts an intermediate transfer member 15 positioned between an imaging member 10 and a transfer roller 9. The imaging member 10 is exemplified by a photoreceptor drum. However, other appropriate imaging members may include other electrostatographic imaging receptors such as ionographic belts and drums, electrophotographic belts, and the like.

In the multi-imaging system of FIG. 2, each image being transferred is formed on the imaging drum by image forming station 13. Each of these images is then developed at developing station 14 and transferred to intermediate transfer member 15. Each of the images may be formed on the photoreceptor drum 10 and developed sequentially and then transferred to the intermediate transfer member 15. In an alternative method, each image may be formed on the photoreceptor drum 10, developed, and transferred in registration to the intermediate transfer member 15. In a preferred embodiment of the invention, the multi-image system is a color copying system. In this color copying system, each color of an image being copied is formed on the photoreceptor drum 10. Each color image is developed and transferred to the intermediate transfer member 15. In the alternative method, each color of an image may be formed on the photoreceptor drum 10, developed, and transferred in registration to the intermediate transfer member 15.

Subsequent to development, the charged toner particles 3 from the developing station 14 are attracted and held by the photoreceptor drum 10 because the photoreceptor drum 10 possesses a charge 2 opposite to that of the toner particles 3. In FIG. 2, the toner particles are shown as negatively charged and the photoreceptor drum 10 is shown as positively charged. These charges can be reversed, depending on the nature of the toner and the machinery being used. In a preferred embodiment, the toner is present in a liquid developer. However, the present invention, in embodiments, is useful for dry development systems also.

A biased transfer roller 9 positioned opposite the photoreceptor drum 10 has a higher voltage than the surface of the photoreceptor drum 10. Biased transfer roller 9 charges the backside 6 of intermediate transfer member 15 with a positive charge. In an alternative embodiment of the invention, a corona or any other charging mechanism may be used to charge the backside 6 of the intermediate transfer member 15.

The negatively charged toner particles 3 are attracted to the front side 5 of the intermediate transfer member 15 by the positive charge 1 on the backside 6 of the intermediate transfer member 15.

The intermediate transfer member may be in the form of a sheet, web or belt as it appears in FIG. 2, or in the form of a roller or other suitable shape. In a preferred embodiment of the invention, the intermediate transfer member is in the form of a belt. In another embodiment of the invention, not shown in the Figures, the intermediate transfer member may be in the form of a sheet.

After the toner latent image has been transferred from the photoreceptor drum 10 to the intermediate transfer member 15, the intermediate transfer member may be contacted under heat and pressure to an image receiving substrate such as paper. The toner image on the intermediate transfer member 15 is then transferred and fixed, in image configuration, to a substrate such as paper.

Figure 3:
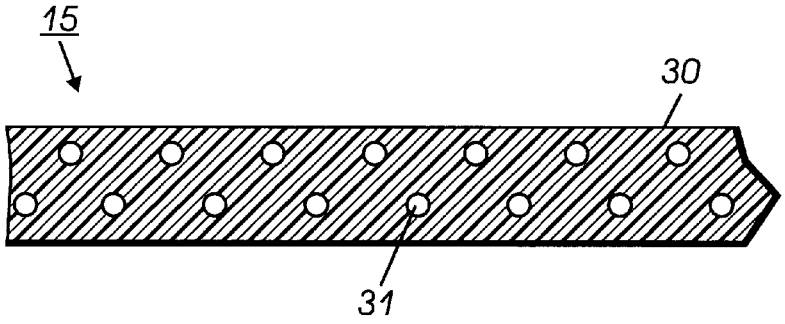
FIG. 3 is an illustration of an embodiment of the invention, wherein a one layer intermediate transfer member comprising a fluorinated carbon filled polyimide substrate described herein is shown.

FIG. 3 shows a sectional view of an example of an intermediate transfer member 15 according to an embodiment of the present invention and depicts a fluorinated carbon filled polyimide layer 30. The fluorinated carbon fillers 31 are depicted as being in a dispersed phase in the polyimide material. The intermediate transfer member 15 can be a single layer as shown in FIG. 3, wherein the substrate comprises the fluorinated carbon filled polyimide or it can be several layers, for example from about 2 to about 5, of a fluorinated carbon filled polyimide material.

Figure 4:
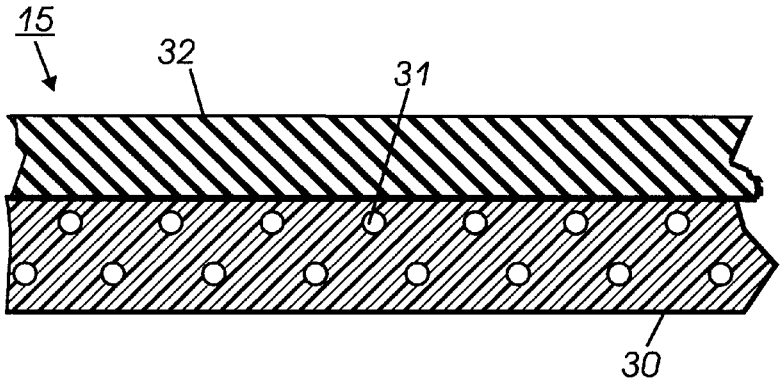
FIG. 4 is a sectional view of an embodiment of the present invention, wherein an intermediate transfer member comprises a fluorinated carbon filled polyimide substrate and thereon a releasable conformable layer.

FIG. 4 depicts an embodiment of the invention wherein the intermediate transfer member 15 comprises a fluorinated carbon filled polyimide substrate 30 having an intermediate releasable conformable layer 32 positioned thereon.

Figure 5:
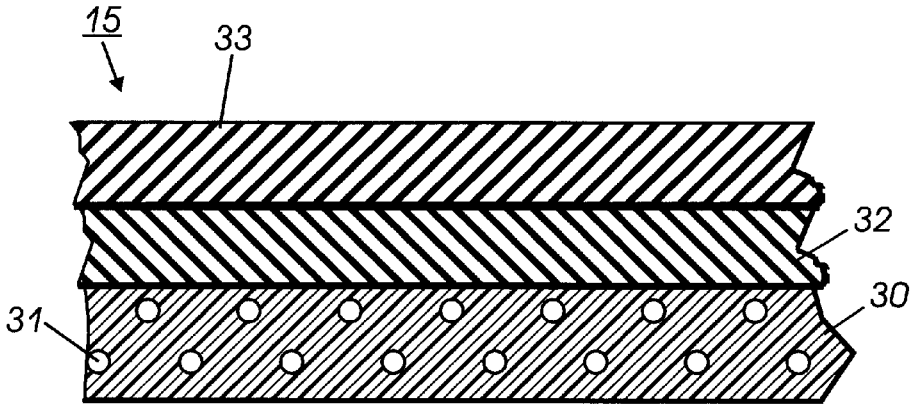
FIG. 5 is a sectional view of an embodiment of the present invention, wherein an intermediate transfer member comprises a fluorinated carbon filled polyimide substrate having thereon a releasable conformable layer, and on the conformable layer, a toner release layer.

FIG. 5 depicts an embodiment of the present invention, wherein the intermediate transfer member 15 comprises a fluorinated carbon filled polyimide substrate 30, an intermediate releasable conformable layer 32, and positioned on the intermediate layer is an outer toner release layer 33.

The fluorinated carbon filled polyimide substrate can comprise a polyimide having a suitable high tensile modulus, and preferably, the polyimide is one that is capable of becoming a conductive film upon the addition of electrically conductive particles. A polyimide having a high tensile modulus is preferred because the high tensile modulus optimizes the film stretch registration and transfer conformance. The fluorinated carbon filled polyimide substrate has the advantages of improved flex life and image registration, chemical stability to liquid developer or toner additives, thermal stability for transfer applications and for improved overcoating manufacturing, improved solvent resistance as compared to a number of known materials used for film for transfer components, and improved electrical properties including a uniform resistivity within the desired range.

The two layer or three layer configurations which include a conformable layer are preferred for use in color toner applications. The conformable configuration is preferred for color in that the conformable surface is able to conform to match the topography or contour of the surface of the substrate. The image produced on such a conformable surface, in embodiments, will have complete images, high resolution images, decrease in color shifting and color deterioration, and a decrease in incomplete areas where the toner is unable to contact the substrate.

Specific examples of suitable polyimides useful in the fluorinated carbon filled polyimide layer include PAI (polyamideimide), PI (polyimide), polyaramide, polyphthalamide, fluorinated polyimides, polyimidesulfone, polyimide ether, and the like. Specific examples are set forth in U.S. Pat. No. 5,037,587, the disclosure of which is herein incorporated by reference in its entirety. The polyimide is preferably capable of exhibiting high mechanical strength, be flexible, and be resistive.

The polyimides may be synthesized by prepolymer solutions such as polyamic acid or esters of polyamic acid, or by the reaction of a dianhydride and a diamine. Preferred polyamic acids can be purchased from E. I. DuPont.

Suitable dianhydrides include aromatic dianhydrides and aromatic tetracarboxylic acid dianhydrides such as, for example, 9,9-bis(trifluoromethyl)xanthene-2,3,6,7-tetracarboxylic acid dianhydride, 2,2-bis-(3,4-dicarboxyphenyl)-hexafluoropropane dianhydride, 2,2-bis((3,4-dicarboxyphenoxy)phenyl)-hexafluoropropane dianhydride, 4,4'-bis(3,4-dicarboxy-2,5,6-trifluorophenoxy)octafluorobiphenyl dianhydride, 3,3',4,4'-tetracarboxybiphenyl dianhydride, 3,3',4,4'-tetracarboxybenzophenone dianhydride, di-(4-(3,4-dicarboxyphenoxy)phenyl)-ether dianhydride, di-(4-(3,4-dicarboxyphenoxy)phenyl)-sulfide dianhydride, di-(3,4-dicarboxyphenyl)methane dianhydride, di-(3,4-dicarboxyphenyl)-ether dianhydride, 1,2,4,5-tetracarboxybenzene dianhydride, 1,2,4-tricarboxybenzene dianhydride, butanetetracarboxylic dianhydride, cyclopentanetetracarboxylic dianhydride, pyromellitic dianhydride, 1,2,3,4-benzenetetracarboxylic dianhydride, 2,3,6,7-naphthalenetetracarboxylic dianhydride, 1,4,5,8-naphthalenetetracarboxylic dianhydride, 1,2,5,6-naphthalenetetracarboxylic dianhydride, 3,4,9,10-perylenetetracarboxylic dianhydride, 2,3,6,7-anthracenetetracarboxylic dianhydride, 1,2,7,8-phenanthrenetetracarboxylic dianhydride, 3,3',4,4'-biphenyltetracarboxylic dianhydride, 2,2',3,3'-biphenyltetracarboxylic dianhydride, 3,3',4-4'-benzophenonetetracarboxylic dianhydride, 2,2',3,3'-benzophenonetetracarboxylic dianhydride, 2,2-bis(3,4-dicarboxyphenyl)propane dianhydride, 2,2-bis(2,3-dicarboxyphenyl)-propane dianhydride, bis(3,4-dicarboxyphenyl)ether dianhydride, bis(2,3-dicarboxyphenyl)ether dianhydride, bis(3,4-dicarboxyphenyl) sulfone dianhydride, bis(2,3-dicarboxyphenyl)sulfone 2,2-bis(3,4-dicarboxyphenyl) -1,1,1 ,3,3,3-hexafluoropropane dianhydride, 2,2-bis(3,4-dicarboxyphenyl) -1,1,1 ,3,3,3-hexachloropropane dianhydride, 1,1-bis(2,3-dicarboxyphenyl)ethane dianhydride, 1,1-bis(3,4-dicarboxyphenyl)ethane dianhydride, bis(2,3-dicarboxyphenyl)methane dianhydride, bis(3,4-dicarboxyphenyl)methane dianhydride, 4,4'-(p-phenylenedioxy)-diphthalic dianhydride, 4,4'-(m-phenylenedioxy)diphthalic dianhydride, 4,4'-diphenylsulfidedioxybis(4-phthalic acid) dianhydre 4,4'-diphenylsulfonedioxybis(4-phthalic acid)dianhydride, methylenebis(4-phenyleneoxy-4-phthalic acid)dianhydride, ethylidenebis(4-phenyleneoxy-4phthalic acid)dianhydride, isopropylidenebis-(4-phenyleneoxy-4-phthalic acid) dianhydride, hexafluoroisopropylidenebis-(4-phenyleneoxy-4-phthalic acid)dianhydride, and the like.

Exemplary diamines suitable for use in the preparation of the polyimide include aromatic diamines such as 4,4'-bis-(m-aminophenoxy)-biphenyl, 4,4'-bis-(m-aminophenoxy)-diphenyl sulfide, 4,4'-bis-(m-aminophenoxy)-diphenyl sulfone, 4,4'-bis-(p-aminophenoxy)-benzophenone, 4,4'-bis-(p-aminophenoxy)-diphenyl sulfide, 4,4'-bis(p-aminophenoxy)-diphenyl sulfone, 4,4'-diamino-azobenzene, 4,4'-diaminobiphenyl, 4,4'-diaminodiphenylsulfone, 4,4'-diamino-p-terphenyl, 1,3,-bis-(gamma-aminopropyl)-tetramethyl-disiloxane, 1,6-diaminohexane, 4,4'-diaminodiphenylmethane, 3,3'-diaminodiphenylmethane, 1,3,-diaminobenzene, 4,4'-diaminodiphenyl ether, 2,4'-diaminodiphenylether, 3,3'-diaminodiphenylether, 3,4'-diaminodiphenylether, 1,4-diaminobenzene, 4,4'-diamino-2,2',3,3',5,5',6,6'-octafluoro-biphenyl, 4,4'-diamino-2,2',3,3',5,5', 6,6'-octafluorodiphenyl ether, bis [4-(3-aminophenoxy)-phenyl] sulfide, bis [4-(3-aminophenoxy)phenyl] sulfone, bis [4-(3-aminophenoxy)phenyl] ketone, 4,4'-bis(3-aminophenoxy)biphenyl, 2,2-bis [4-(3-aminophenoxy) phenyl]-propane, 2,2-bis [4-(3-aminophenoxy)phenyl]-1,1,1 ,3,3,3-hexafluoropropane, 4,4'-diaminodiphenyl sulfide, 4,4'-diaminodiphenyl ether, 4,4'-diaminodiphenyl sulfone, 4,4'-diaminodiphenylmethane, 1,1-di(p-aminophenyl) ethane, 2,2-di(p-aminophenyl)propane, and 2,2-di(p-aminophenyl)-1,1,1,3,3,3-hexafluoropropane.

The dianhydrides and diamines are preferably used in a weight ratio of dianhydride to diamine of from about 20:80 to about 80:20, and preferably about 50:50 weight ratio. The above aromatic dianhydride (preferably aromatic tetracarboxylic acid dianhydride) and diamine (preferably aromatic diamine) are used singly or as a mixture, respectively. The polyimide can be prepared from the dianhydride and diamine by known methods. For example, the dianhydride and the diamine can be suspended or dissolved in an organic solvent as a mixture or separately and can be reacted to form the polyamic acid, which is thermally or chemically dehydrated and the product is separated and purified. The polyimide is heat-melted with a known extruder, delivered in the form of a film from a die having a slit nozzle, and a static charge is applied to the film, the film is cooled and solidified with a cooling roller having a surface temperature in the range of glass transition temperature (Tg) of the polymer (Tg)−50° to (Tg)−15° C., transmitted under tension without bringing the film into contact with rollers while further cooling to the room temperature, and wound up or transferred to a further step.

In a preferred embodiment of the invention, the fluorinated carbon is added to a polyimide prepolymer, such as polyamic acid, in solution, and subsequently formed into a layer, sheet, film, or the like. The prepolymer/fluorinated carbon solution can then be processed by known procedures such as roll and/or ball milling, drying and curing. Processes for preparing polyimide/fluorinated carbon solutions from polyimide prepolymers are disclosed in U.S. Pat. Nos. 5,591,285 and 5,571,852. The disclosures of each of these Patents are hereby incorporated by reference in their entirety.

As a preferred procedure for generating the polyimide substrates, the polyamic acid solutions (or prepolymer solutions) can be prepared by reacting a diamine, such as oxydianiline, with a tetracarboxylic acid dianydride, such as hydromellitic dianhydride or benzophenone tetracarboxylic acid dianhydride in a solvent, such as N-methylpyrrolidine (NMP) or N,N-dimethylacetamide in a dry inert atmosphere. The mixture is usually stirred overnight (about 8 hours) or heated to reflux if required to form the polyamic acid solution. The solid content ranges from about 10 to about 20% by weight. The fluorinated carbon is then added. A paint shaker or roll mill can be used to aid in the dispersion process. The substrates can be prepared by first making a film from the fluorinated carbon/polyamic acid dispersion followed by curing the film to fully imidize the precursor polymer. Processes used to coat the film are well-known in the art and include spin-casting, solution coating, extrusion, hot-mold, and other known methods. The coated films can be heated at 100° C. for about 1 to about 2 hours to remove the solvent, and then cured at 200° C. for about 2 to 3 hours. The films can then be imidized at 350° C. for about 1 to 2 hours. The polyimide/fluorinated carbon films can then be formed into a layer or an endless seamless belt.

There are other polyimides which may be prepared as fully imidized polymers which do not contain any "amic" acid and do not require high temperature cure to convert them to the imide form. A typical polyimide of this type may be prepared by reacting di-(2,3-dicarboxyphenyl)-ether dianhydride with 5-amino-1-(p-aminophenyl)-1,3.3-trimethylindane. This polymer is available as Polyimide XU 218 sold by Ciba-Geigy Corporation, Ardsley, N.Y. Other fully imidized polyimides are available from Lenzing, USA corporation in Dallas, Tex. and are sold as Lenzing P83 polyimide and by Mitsui Toatsu Chemicals, New York, N.Y. sold as Larc-TPI. These fully imidized polyimides are first dissolved in a solvent such as dimethylformamide, dimethylpyrralidone, dimethylacetamide and then combined with the fluorinated carbon as discussed above to be formed into a layer, sheet, film or the like. Evaporation of the solvent produces a film, sheet, or layer without high temperature exposure typically required for conversion of the amic acid to an imide polymer structure.

The polyimide is present in the fluorinated carbon filled polyimide substrate in an amount of from about 50 to about 99 percent by weight of total solids, preferably from about 99 to about 60, and particularly preferred from about 95 to about 30 percent by weight of total solids. Total solids includes the total percentage by weight (equal to 100%) of polyimide, fluorinated carbon, any additional fillers and any additives in the layer.

It is preferable that fluorinated carbon is dispersed in the polyimide layer. Fluorinated carbon, sometimes referred to as graphite fluoride or carbon fluoride, is a solid material resulting from the fluorination of carbon with elemental fluorine. The number of fluorine atoms per carbon atom may vary depending on the fluorination conditions. The variable fluorine atom to carbon atom stoichiometry of fluorinated carbon permits systemic, uniform variation of its electrical resistivity properties.

Fluorinated carbon refers to a specific class of compositions which is prepared by reacting fluorine to one or more of the many forms of solid carbon. In addition, the amount of fluorine can be varied in order to produce a specific, desired resistivity. Fluorocarbons are either aliphatic or aromatic organic compounds wherein one or more fluorine atoms have been attached to one or more carbon atoms to form well defined compounds with a single sharp melting point or boiling point. Fluoropolymers are linked-up single identical molecules which comprise long chains bound together by covalent bonds. Moreover, fluoroelastomers are a specific type of fluoropolymer. Thus, despite some apparent confusion in the art, it is apparent that fluorinated carbon is neither a fluorocarbon nor a fluoropolymer and the term is used in this context herein.

The fluorinated carbon may include the fluorinated carbon materials as described herein. The methods for preparation of fluorinated carbon are well known and documented in the literature, such as in the following U.S. Pat. Nos. 2,786,874; 3,925,492; 3,925,263; 3,872,032 and 4,247,608, the disclosures each of which are totally incorporated by reference herein. Essentially, fluorinated carbon is produced by heating a carbon source such as amorphous carbon, coke, charcoal, carbon black or graphite with elemental fluorine at elevated temperatures, such as 150°–600° C. A diluent such as nitrogen is preferably admixed with the fluorine. The nature and properties of the fluorinated carbon vary with the particular carbon source, the conditions of reaction and with the degree of fluorination obtained in the final product. The degree of fluorination in the final product may be varied by changing the process reaction conditions, principally temperature and time. Generally, the higher the temperature and the longer the time, the higher the fluorine content.

Fluorinated carbon of varying carbon sources and varying fluorine contents is commercially available from several sources. Preferred carbon sources are carbon black, crystalline graphite and petroleum coke. One form of fluorinated carbon which is suitable for use in accordance with the invention is polycarbon monofluoride which is usually written in the shorthand manner $CF_x$ with x representing the number of fluorine atoms and generally being up to about 1.5, preferably from about 0.01 to about 1.5, and particularly preferred from about 0.04 to about 1.4. The formula $CF_x$ has a lamellar structure composed of layers of fused six carbon rings with fluorine atoms attached to the carbons and lying above and below the plane of the carbon atoms. Preparation of $CF_x$ type fluorinated carbon is described, for example, in above-mentioned U.S. Pat. Nos. 2,786,874 and 3,925,492, the disclosures of which are incorporated by reference herein in their entirety. Generally, formation of this type of fluorinated carbon involves reacting elemental carbon with $F_2$ catalytically. This type of fluorinated carbon can be obtained commercially from many vendors, including Allied Signal, Morristown, N.J.; Central Glass International, Inc., White Plains, N.Y.; Diakin Industries, Inc., New York, N.Y.; and Advance Research Chemicals, Inc., Catoosa, Okla.

Another form of fluorinated carbon which is suitable for use in accordance with the invention is that which has been postulated by Nobuatsu Watanabe as poly(dicarbon monofluoride) which is usually written in the shorthand manner $(C_2F)_n$. The preparation of $(C_2F)_n$ type fluorinated carbon is described, for example, in above-mentioned U.S. Pat. No. 4,247,608, the disclosure of which is herein incorporated by reference in its entirety, and also in Watanabe et al., "Preparation of Poly(dicarbon monofluoride) from Petroleum Coke", Bull. Chem. Soc. Japan, 55, 3197–3199 (1982), the disclosure of which is also incorporated herein by reference in its entirety.

In addition, preferred fluorinated carbons selected include those described in U.S. Pat. No. 4,524,119 to Luly et al., the subject matter of which is hereby incorporated by reference in its entirety, and those having the tradename ACCUFLUOR®, (ACCUFLUOR® is a registered trademark of Allied Signal, Morristown, N. J.) for example, ACCUFLUOR® 2028, ACCUFLUOR® 2065, ACCUFLUOR® 1000, and ACCUFLUOR® 2010. ACCUFLUOR® 2028 and ACCUFLUOR® 2010 have 28 and 11 percent fluorine content, respectively. ACCUFLUOR® 1000 and ACCUFLUOR® 2065 have 62 and 65 percent fluorine content respectively. Also, ACCUFLUOR® 1000 comprises carbon coke, whereas ACCUFLUOR® 2065, 2028 and 2010 all comprise conductive carbon black. These fluorinated carbons are of the formula $CF_x$ and are formed by the reaction of $C+F_2=CF_x$.

The following Table 1 illustrates some properties of four known fluorinated carbons.

TABLE 1

| PROPERTIES | ACCUFLUOR ® | | | | UNITS |
|---|---|---|---|---|---|
| GRADE | 1000 | 2065 | 2028 | 2010 | N/A |
| Feedstock | Coke | Conductive Carbon Black | | | N/A |
| Fluorine Content | 62 | 65 | 28 | 11 | % |
| True Density | 2.7 | 2.5 | 2.1 | 1.9 | g/cc |
| Bulk Density | 0.6 | 0.1 | 0.1 | 0.09 | g/cc |
| Decomposition Temperature | 630 | 500 | 450 | 380 | ° C. |
| Median Particle Size | 8 | <1 | <1 | <1 | micrometers |
| Surface Area | 130 | 340 | 130 | 170 | $m^2/g$ |
| Thermal Conductivity | $10^{-3}$ | $10^{-3}$ | $10^{-3}$ | N.A. | cal/cm – sec – ° C. |
| Electrical Resistivity | $10^{11}$ | $10^{11}$ | $10^{8}$ | <10 | ohm – cm |
| Color | Gray | White | Black | Black | N/A |

A major advantage of the invention is the capability to vary the fluorine content of the fluorinated carbon to permit systematic uniform variation of the resistivity properties of the polyimide layer. The preferred fluorine content will depend on, inter alia, the equipment used, equipment settings, desired resistivity, and the specific fluoroelastomer chosen. The fluorine content in the fluorinated carbon is from about 1 to about 70 weight percent based on the weight of fluorinated carbon (carbon content of from about 99 to about 30 weight percent), preferably from about 5 to about 65 (carbon content of from about 95 to about 35 weight percent), and particularly preferred from about 10 to about 30 weight percent (carbon content of from about 90 to about 70 weight percent).

The median particle size of the fluorinated carbon can be less than about 1 micron and up to about 10 microns, is preferably less than about 1 micron, preferably from about 0.001 to about 1 microns, and particularly preferred from about 0.5 to 0.9 micron. The surface area is preferably from about 100 to about 400 $m^2/g$, preferred of from about 110 to about 340, and particularly preferred from about 130 to about 170 $m^2/g$. The density of the fluorinated carbons is preferably from about 1.5 to about 3 g/cc, preferably from about 1.9 to about 2.7 g/cc.

The amount of fluorinated carbon in the polyimide layer is preferably an amount to provide a surface resistivity of from about $10^4$ to about $10^{14}$, and preferably from about $10^6$ to about $10^{12}$ ohms/sq. Preferably, the amount of fluorinated carbon is from about 1 to about 50 percent by weight, preferably from about 1 to about 40 weight percent, and particularly preferred from about 5 to about 30 weight percent based on the weight of total solids. Total solids as used herein refers to the amount of polyimide, fluorinated carbon, additives, and any other fillers.

It is preferable to mix different types of fluorinated carbon to tune the mechanical and electrical properties. It is desirable to use mixtures of different kinds of fluorinated carbon to achieve suitable resistivity while increasing the dimensional stability of the polyimide substrate. Also, mixtures of different kinds of fluorinated carbon can provide an unexpected wide formulation latitude and controlled and predictable resistivity. For example, an amount of from about 0 to about 40 percent, preferably from about 1 to about 40, and particularly preferred of from about 5 to about 35 percent by weight of ACCUFLUOR® 2010 can be mixed with an amount of from about 0 to about 40 percent, preferably from about 1 to about 40, and particularly preferred from about 5 to about 35 percent ACCUFLUOR® 2028, and even more particularly preferred from about 8 to about 25 percent ACCUFLUOR® 2028. Other forms of fluorinated carbon can also be mixed. Another example is an amount of from about 0 to about 40 percent ACCUFLUOR® 1000, and preferably from about 1 to about 40 percent, and particularly preferred from about 5 to about 35 percent, mixed with an amount of from about 0 to about 40 percent, preferably from about 1 to about 40, and particularly preferred from about 1 to about 35 percent ACCUFLUOR® 2065. All other combinations of mixing the different forms of ACCUFLUOR® are possible. A preferred mixture is from about 0 to about 15 percent ACCUFLUOR® 2028 mixed with from about 2 to about 3.5 percent ACCUFLUOR® 2010. Another preferred mixture is from about 0.5 to about 10 percent ACCUFLUOR® 2028 mixed with from about 2.0 to about 3.0 percent ACCUFLUOR® 2010. A particularly preferred mixture contains from about 1 to about 3 percent ACCUFLUOR® 2028 mixed with from about 2.5 to about 3 percent ACCUFLUOR® 2010, and even more preferred contains a mixture of about 3 percent ACCUFLUOR® 2010 and about 2 percent ACCUFLUOR® 2028. All the above percentages are by weight of the total solids.

The tensile strength of the fluorinated carbon filled substrate is from about 10,000 to about 50,000 PSI, and preferably from about 10,000 to about 25,000 PSI. The tensile modulus is from about 100,000 to about 2,000,000 PSI, and preferably from about 200,000 to about 1,500,000 PSI. The thickness of the substrate is from about 1 to about 10 mil, preferably from about 2 to about 5 mil.

The intermediate transfer member employed for the present invention can be of any suitable configuration. Examples of suitable configurations include a sheet, a film, a web, a foil, a strip, a coil, a cylinder, a drum, an endless strip, a circular disc, a belt including an endless belt, an endless seamed flexible belt, an endless seamless flexible belt, an endless belt having a puzzle cut seam, and the like. It is preferred that the substrate be an endless seamed flexible belt or seamed flexible belt, which may or may not include puzzle cut seams. Examples of such belts are described in U.S. Pat. Nos. 5,487,707; 5,514,436; and U.S. patent application Ser. No. 08/297,203 filed Aug. 29, 1994, now abandoned, the disclosures each of which are incorporated herein by reference in their entirety. A method for manufacturing reinforced seamless belts is set forth in U.S. Pat. No. 5,409,557, the disclosure of which is hereby incorporated by reference in its entirety. The circumference of the component in a film or belt configuration of from 1 to 3 or more layers, is from about 8 to about 60 inches, preferably from about 10 to about 50 inches, and particularly preferred from about 15 to about 35 inches. The width of the film or belt is from about 8 to about 40 inches, preferably from about 10 to about 36 inches, and particularly preferred from about 10 to about 24 inches.

In a preferred two-layer configuration as depicted in FIG. 4, the outer conformable layer 32 is positioned on the fluorinated carbon filled polyimide substrate. The outer layer 32 has a thickness of from about 1 to about 10 mil, preferably from about 2 to about 5 mil. The hardness of the conformable outer layer is from about 30 to about 80 Shore A, and preferably from about 35 to about 75 Shore A.

Examples of suitable conformable layers herein include polymers such as fluoropolymers. Preferred are fluoroelastomers. Specifically, suitable fluoroelastomers are those described in detail in U.S. Pat. Nos. 5,166,031, 5,281,506, 5,366,772 and 5,370,931, together with U.S. Pat. Nos. 4,257,699, 5,017,432 and 5,061,965, the disclosures each of which are incorporated by reference herein in their entirety. As described therein these fluoroelastomers, particularly from the class of copolymers and terpolymers of vinylidenefluoride, hexafluoropropylene and tetrafluoroethylene, are known commercially under various designations as VITON® A, VITON® E, VITON® E60C, VITON® E430, VITON® 910, VITON® GH, VITON® B50, VITON® E45, and VITON® GF. The VITON® designation is a Trademark of E. I. DuPont de Nemours, Inc. Other commercially available materials include FLUOREL® 2170, FLUOREL® 2174, FLUOREL® 2176, FLUOREL® 2177 and FLUOREL® LVS 76 FLUOREL® being a Trademark of 3M Company. Additional commercially available materials include AFLAS™ a poly (propylene-tetrafluoroethylene) and FLUOREL II® (LII900) a poly(propylene-tetrafluoroethylenevinylidenefluoride) both also available from 3M Company, as well as the Tecnoflons identified as FOR-60KIR®, FOR-LHF®, NM® FOR-THF®, FOR-TFS®, TH®, TN505® available from Montedison Specialty Chemical Company. In another preferred embodiment, the fluoroelastomer is one having a relatively low quantity of vinylidenefluoride, such as in VITON® GF, available from E. I. DuPont de Nemours, Inc. The VITON® GF has 35 mole percent of vinylidenefluoride, 34 mole percent of hexafluoropropylene and 29 mole percent of tetrafluoroethylene with 2 percent cure site monomer. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer commercially available from DuPont or any other manufacturer.

Examples of fluoroelastomers suitable for use herein for the conformable layers include elastomers of the above type, along with volume grafted elastomers. Volume grafted elastomers are a special form. of hydrofluoroelastomer and are substantially uniform integral interpenetrating networks of a hybrid composition of a fluoroelastomer and a polyorganosiloxane, the volume graft having been formed by dehydrofluorination of fluoroelastomer by a nucleophilic dehydrofluorinating agent, followed by addition polymerization by the addition of an alkene or alkyne functionally terminated polyorganosiloxane and a polymerization initiator. Examples of specific volume graft elastomers are disclosed in U.S. Pat. Nos. 5,166,031; 5,281,506; 5,366,772; and 5,370,931, the disclosures each of which are herein incorporated by reference in their entirety.

Volume graft, in embodiments, refers to a substantially uniform integral interpenetrating network of a hybrid composition, wherein both the structure and the composition of the fluoroelastomer and polyorganosiloxane are substantially uniform when taken through different slices of the intermediate transfer member. A volume grafted elastomer is a hybrid composition of fluoroelastomer and polyorganosiloxane formed by dehydrofluorination of fluoroelastomer by nucleophilic dehydrofluorinating agent followed by addition polymerization by the addition of alkene or alkyne functionally terminated polyorganosiloxane.

Interpenetrating network, in embodiments, refers to the addition polymerization matrix where the fluoroelastomer and polyorganosiloxane polymer strands are intertwined in one another.

Hybrid composition, in embodiments, refers to a volume grafted composition which is comprised of fluoroelastomer and polyorganosiloxane blocks randomly arranged.

Generally, the volume grafting according to the present invention is performed in two steps, the first involves the dehydrofluorination of the fluoroelastomer preferably using an amine. During this step, hydrofluoric acid is eliminated which generates unsaturation, carbon to carbon double bonds, on the fluoroelastomer. The second step is the free radical peroxide induced addition polymerization of the alkene or alkyne terminated polyorganosiloxane with the carbon to carbon double bonds of the fluoroelastomer. In embodiments, copper oxide can be added to a solution containing the graft copolymer. The dispersion is then provided onto the intermediate transfer member or conductive film surface.

In embodiments, the polyorganosiloxane having functionality according to the present invention has the formula:

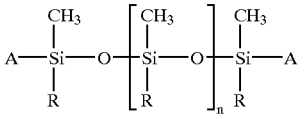

where R is an alkyl from about 1 to about 24 carbons, or an alkenyl of from about 2 to about 24 carbons, or a substituted or unsubstituted aryl of from about 6 to about 18 carbons; A is an aryl of from about 6 to about 24 carbons, a substituted or unsubstituted alkene of from about 2 to about 8 carbons, or a substituted or unsubstituted alkyne of from about 2 to about 8 carbons; and n represents the number of segments and is, for example, from about 2 to about 400, and preferably from about 10 to about 200 in embodiments.

In preferred embodiments, R is an alkyl, alkenyl or aryl, wherein the alkyl has from about 1 to about 24 carbons, preferably from about 1 to about 12 carbons; the alkenyl has from about 2 to about 24 carbons, preferably from about 2 to about 12 carbons; and the aryl has from about 6 to about 24 carbon atoms, preferably from about 6 to about 18 carbons. R may be a substituted aryl group, wherein the aryl may be substituted with an amino, hydroxy, mercapto or substituted with an alkyl having for example from about 1 to about 24 carbons and preferably from 1 to about 12 carbons, or substituted with an alkenyl having for example from about 2 to about 24 carbons and preferably from about 2 to about 12 carbons. In a preferred embodiment, R is independently selected from methyl, ethyl, and phenyl. The functional group A can be an alkene or alkyne group having from about 2 to about 8 carbon atoms, preferably from about 2 to about 4 carbons, optionally substituted with an alkyl having for example from about 1 to about 12 carbons, and preferably from about 1 to about 12 carbons, or an aryl group having for example from about 6 to about 24 carbons, and preferably from about 6 to about 18 carbons. Functional group A can also be mono-, di-, or trialkoxysilane having from about 1 to about 10 and preferably from about 1 to about 6 carbons in each alkoxy group, hydroxy, or halogen. Preferred alkoxy groups include methoxy, ethoxy, and the like. Preferred halogens include chlorine, bromine and fluorine. A may also be an alkyne of from about 2 to about 8 carbons, optionally substituted with an alkyl of from about 1 to about 24 carbons or aryl of from about 6 to about 24 carbons. The group n is from about 2 to about 400, and in embodiments from about 2 to about 350, and preferably from about 5 to about 100. Furthermore, in a preferred embodiment n is from about 60 to about 80 to provide a sufficient number of reactive groups to graft onto the fluoroelastomer. In the above formula, typical R groups include methyl, ethyl, propyl, octyl, vinyl, allylic crotnyl, phenyl, naphthyl and phenanthryl, and typical substituted aryl groups are substituted in the ortho, meta and para positions with lower alkyl groups having from about 1 to about 15 carbon atoms. Typical alkene and alkenyl functional groups include vinyl, acrylic, crotonic and acetenyl which may typically be substituted with methyl, propyl, butyl, benzyl, tolyl groups, and the like.

The amount of fluoroelastomer used to provide the conformable layers of the present invention is dependent on the amount necessary to form the desired thickness of the layer or layers. Specifically, the fluoroelastomer for the outer layer is added in an amount of from about 60 to about 99 percent, preferably about 70 to about 99 percent by weight of total solids. Total solids herein means the amount of fluoroelastomer, fillers, and any additional additives.

Preferably, the conformable layer contains a filler such as carbon black, graphite, fluorinated carbon as described herein, a metal powder, a metal oxide such as tin oxide, or a mixture thereof. Preferred fillers include fluorinated carbons as described herein.

In another preferred embodiment, the intermediate transfer belt is in the form of a three layer configuration as shown in FIG. 5. The outer toner release layer 33 is positioned on the intermediate conformable layer 32, which is positioned on the polyimide substrate. The polyimide substrate is as defined above, and the conformable layer is as defined above.

This outer layer is preferably thin, having a thickness of from about 0.1 to about 5 mils, and preferably from about 0.2 to about 2 mils. The hardness of the outer release layer is preferably from about 30 to about 80 Shore A, and preferably from about 35 to about 65 Shore A. The outer release layer is made of a known material suitable for release such as, for example, a silicone rubber. Specific examples of silicone rubbers useful herein include Silicone 552 available from Sampson Coating, Inc. Richmond, Va.; Eccosil 4952D available from Emerson Cuming, Inc., Burn, Mass.; Dow Corning DC-437 Silicone available from Dow Corning, Midland, Mich. and any other suitable commercially available silicone material. Preferably, the outer layer does not include a filler. The three layer configuration works very well with liquid development and is the preferred configuration of the present invention.

Optional intermediate adhesive layers and/or polymer layers may be applied to achieve desired properties and performance objectives of the present conductive film. An adhesive intermediate layer may be selected from, for example, epoxy resins and polysiloxanes. Preferred adhesives are proprietary materials such as THIXON 403/404, Union Carbide A-1100, Dow TACTIX 740, Dow TACTIX 741, and Dow TACTIX 742. A particularly preferred curative for the aforementioned adhesives is Dow H41.

In the two layer configuration, there may be provided an adhesive layer between the polyimide substrate and the outer fluoropolymer layer. In the three layer configuration, there may also be an adhesive layer between the intermediate conductive fluoropolymer layer and the outer silicone layer, and/or between the intermediate fluoroelastomer layer and the polyimide substrate.

Specific embodiments of the invention will now be described in detail. These examples are intended to be illustrative, and the invention is not limited to the materials, conditions, or process parameters set forth in these embodiments. All parts are percentages by weight of total solids unless otherwise indicated.

EXAMPLES

Example 1

Prototype resistive fluorinated polyimide layers containing fluorinated carbon ACCUFLUOR® 2028 were prepared in the following manner. About 0.8 grams of ACCUFLUOR® 2028 was dispersed ultrasonically in 10 grams of N-methylpyrrolidine (NMP) for about 10 minutes. This dispersion was then combined with 50 grams of a polyamic acid solution (PI-2566, 16.9% solid content, from E. I. DuPont) inside a 4 ounce bottle and the mixture was homogenized on a paint shaker for approximately bottle and the mixture was homogenized on a paint shaker for approximately 45 minutes. A prototype fluorinated polyimide resistive layer was then coated by coating the above dispersion onto a KAPTON® substrate on a Gardner Laboratory Coater with a 0.01 mil draw bar. The coated layer was then dried at 80° C. for approximately 1 hour, and cured at 235° C. for about 3 to 4 hours and at approximately 350° C. for about 0.5 hours, resulting in a 1 mil thick fluorinated polyimide layer. The fluorinated carbon loading in the layer was determined to be about 8.6%.

The surface resistivity of the fluorinated polyimide layer was measured by a Xerox Corporation testing apparatus consisting of a power supply (Trek 601C Coratrol), a Keithy electrometer (model 610B) and a two point conformable guarded electrode probe (15 mm spacing between the two electrodes). The field applied for the measurement was 1500 V/cm and the measured current was converted to surface resistivity based on the geometry of the probe. The surface resistivity of the layer was determined to be about $1.7\times10^{11}$ ohm/sq.

The volume resistivity of the layer was determined by the standard AC conductivity technique. In this case the layer was coated onto a stainless steel substrate. An evaporated aluminum thin film (300 Å) was used as the counter electrode. The volume resistivity was found to be approximately $5\times 10^{9}$ ohm-cm at an electric field of 1500 V/cm. Surprisingly, the resistivity was found to be substantially insensitive to changes in temperature in the range of about 20° C. to about 150° C., to changes in relative humidity in the range of about 20% to about 80%, and to the intensity of applied electric field (up to 5,000 V/cm). Furthermore, no hysteresis (memory) effect was seen after the layer was cycled to higher electric fields ($>10^{4}$ V/cm).

Example 2

A number of fluorinated polyimide resistive layers were prepared using the above procedure. Varying resistives were obtained by changing the concentration of the ACCUFLUOR® loading. The results are shown in Table 2 below.

TABLE 2

| ACCUFLUOR ® 2028 | Surface Resistivity (Ohm/sq) | Volume Resistivity (ohm – cm) |
|---|---|---|
| 7.6% | $\sim1\times10^{15}$ | $\sim8\times10^{14}$ |
| 9.1% | $\sim3.8\times10^{10}$ | |
| 9.6% | $\sim8.2\times10^{8}$ | $\sim9\times10^{6}$ |
| 10.6% | $\sim7.6\times10^{7}$ | $\sim3\times10^{5}$ |

Example 3

A number of polyimide resistive layers were prepared and evaluated using the above procedure with the exception that polyamic acid solution PI2808 was used in place of PI2566. The surface resistivity results are shown in Table 3 below.

TABLE 3

| ACCUFLUOR ® 2028 | Surface Resistivity (ohms/sq) |
|---|---|
| 8.5% | $\sim1\times10^{14}$ |
| ~9% | $\sim6.4\times10^{12}$ |
| 11% | $\sim1.5\times10^{9}$ |
| 12% | $\sim2.0\times10^{6}$ |
| 13% | $\sim2.5\times10^{6}$ |
| 15% | $\sim2\times10^{6}$ |

Example 4

An intermediate transfer belt comprising a fluorinated carbon filled polyimide layer can be fabricated in the following manner. A coating dispersion containing ACCUFLUOR® 2028 and polyimide in a weight ratio of about 1 to about 10 can be prepared according to the procedures outlined in Example 3. An approximately 3 ml, thick ACCUFLUOR®/polyimide resistive layer can be prepared by spin casting the dispersion on a roll substrate. The resistive layer, after cured as described in Example 1, is estimated to have a surface resistivity of approximately $6\times10^{12}$ ohm/sq.

Example 5

A two-layer intermediate transfer belt comprising a conformable resistive layer and a resistive layer of Example 4 was prepared according to the procedure outlined below.

First, a coating dispersion comprising ACCUFLUOR® 2028, ACCUFLUOR® 2010 and VITON® GF in a weight ratio of 2:3:95 was prepared. The coating dispersion was prepared by first adding a solvent (200 grams of methyl ethyl ketone), a steel shot (2,300 grams), 0.95 grams ACCUFLUOR® 2028 and 1.42 grams ACCUFLUOR® 2010 in a small bench top attritor (model 01A). The mixture was stirred for about one minute so as to wet the fluorinated carbon. A polymer binder, VITON® GF (45 grams) was then added and the resulting mixture was attrited for 30 minutes. A curative package (2.25 grams VC-50, 0.9 grams Maglite-D and 0.2 grams $Ca(OH)_2$) and a stabilizing solvent (10 grams methanol) were then introduced and the resulting mixture was further mixed for another 15 minutes. After filtering the steel shot through a wire screen, the dispersion was collected in a polypropylene bottle. The resulting dispersion was then coated onto KAPTON® substrates within about 2 to 4 hours using a Gardner Laboratory Coater. The coated layers were air-dried for approximately two hours and then step heat cured in a programmable oven. The heating sequence was as follows: (1) 65° C. for 4 hours, (2) 93° C. for 2 hours, (3) 144° C. for 2 hours, (4) 177° C. 2 hours, (5) 204° C. for 2 hours, and (6) 232° C. for 16 hours. This resulted in a VITON® GF layer containing 30% by weight ACCUFLUOR® 2028. The dry thickness of the layers was determined to be approximately 3 mil (about 75 μm). The hardness of this layer was estimated to be about 65 Shore A and the surface resistivity was about $1\times10^{10}$ ohm/sq.

Example 6

A multilayer intermediate transfer belt consisting of an ACCUFLUOR®/polyimide substrate, an ACCUFLUOR®/VITON® resistive conformable layer and a silicone outer layer can be prepared by flow-coating a silicone layer (0.5 mil) onto the belt prepared in Example 5. After coating, the silicone layer can be dried and the entire layered structure can be step heat cured at 120° C. for 3 hours, 177° C. for 4 hours and finally, 232° C. for 2 hours. The multilayer intermediate transfer belts can be particularly suitable for application in liquid xerography.

While the invention has been described in detail with reference to specific and preferred embodiments, it will be appreciated that various modifications and variations will be apparent to the artisan. All such modifications and embodiments as may occur to one skilled in the art are intended to be within the scope of the appended claims.

We claim:

1. An intermediate transfer member comprising a fluorinated carbon filled polyimide substrate and a conformable layer positioned on said fluorinated carbon filled substrate.

2. An intermediate transfer member in accordance with claim 1, wherein said fluorinated carbon is present in an amount of from about 1 to about 50 percent by weight based on the weight of total solids.

3. An intermediate transfer member in accordance with claim 1, wherein said fluorinated carbon has a fluorine content of from about 1 to about 70 weight percent based on the weight of fluorinated carbon, and a carbon content of from about 99 to about 30 weight percent based on the weight of fluorinated carbon.

4. An intermediate transfer member in accordance with claim 1, wherein the fluorinated carbon is of the formula $CF_x$, wherein x represents the number of fluorine atoms and is a number of from about 0.01 to about 1.5.

5. An intermediate transfer member in accordance with claim 1, wherein said fluorinated carbon is selected from the group consisting of a fluorinated carbon having a fluorine content of about 62 weight percent, a fluorinated carbon having a fluorine content of about 11 weight percent, a fluorinated carbon having a fluorine content of about 28 weight percent, and a fluorinated carbon having a fluorine content of about 65 weight percent based on the weight of fluorinated carbon.

6. An intermediate transfer member in accordance with claim 1, wherein the polyimide is generated from the reaction product of a dianhydride with a diamine.

7. An intermediate transfer member in accordance with claim 6, wherein said dianhydride is an aromatic dianhydride.

8. An intermediate transfer member in accordance with claim 7, wherein said dianhydride is selected from the group consisting of 9,9-bis(trifluoromethyl)xanthene-2,3,6,7-tetracarboxylic acid dianhydride, 2,2-bis-(3,4-dicarboxyphenyl)-hexafluoropropane dianhydride, 2,2-bis ((3,4-dicarboxyphenoxy)phenyl)-hexafluoropropane dianhydride, 4,4'-bis(3,4-dicarboxy-2,5,6-trifluorophenoxy) octafluorobiphenyl dianhydride, 3,3',4,4'-tetracarboxybiphenyl dianhydride, 3,3'4,4'-tetracarboxybenzophenone dianhydride, di-(4-(3,4-dicarboxyphenoxy)phenyl)-ether dianhydride, di-(4-(3,4-dicarboxyphenoxy)phenyl)-sulfide dianhydride, di-(3,4-dicarboxyphenyl)methane dianhydride, di-(3,4-dicarboxyphenyl)-ether dianhydride, 1,2,4,5-tetracarboxybenzene dianhydride, and 1,2,4-tricarboxybenzene dianhydride.

9. An intermediate transfer member in accordance with claim 6, wherein said diamine is selected from the group consisting of 4,4'-bis-(m-aminophenoxy)-biphenyl, 4,4'-bis-(m-aminophenoxy)-diphenyl sulfide, 4,4'-bis-(m-aminophenoxy)-diphenyl sulfone, 4,4'-bis-(p-aminophenoxy)-benzophenone, 4,4'-bis-(p-aminophenoxy)-diphenyl sulfide, 4,4'bis(p-aminophenoxy)-diphenyl sulfone, 4,4'-diamino-azobenzene, 4,4'-diaminobiphenyl, 4,4'-diaminodiphenylsulfone, 4,4'-diamino-p-terphenyl, 1,3,-bis-(gamma-aminopropyl)-tetramethyl-disiloxane, 1,6-diaminohexane, 4,4'-diaminodiphenylmethane, 3,3'-diaminodiphenylmethane, 1,3,-diaminobenzene, 4,4'-diaminodiphenyl ether, 2,4'-diaminodiphenylether, 3,3'-diaminodiphenylether, 3,4'-diaminodiphenylether, 1,4-diaminobenzene, 4,4'-diamino-2,2',3,3',5,5',6,6'-octafluorobiphenyl, and 4,4'-diamino-2,2',3,3',5,5',6,6'-octafluorodiphenyl ether.

10. An intermediate transfer member in accordance with claim 1, wherein said member has a surface resistivity of from about $10^4$ to about $10^{14}$ ohms/sq.

11. An intermediate transfer member in accordance with claim 10, wherein said surface resistivity is from about $10^6$ to about $10^{12}$ ohms/sq.

12. An intermediate transfer member in accordance with claim 1, wherein said conformable layer comprises a fluoropolymer.

13. An intermediate transfer member in accordance with claim 12, wherein said fluoropolymer is a fluoroelastomer selected from the group consisting of a) copolymers of vinylidenefloride, hexafluoropropylene and tetrafluoroethylene, b) terpolymers of vinylidenefluoride, hexafluoropropylene and tetrafluoroethylene, and c) tetrapolymers of vinylidenefluoride, hexafluoropropylene, tetrafluoroethylene and a cure site monomer.

14. An intermediate transfer member in accordance with claim 13, wherein said fluoroelastomer comprises about 35 mole percent of vinylidenefluoride, about 34 mole percent of hexafluoropropylene, about 29 mole percent of tetrafluoroethylene, and about 2 mole percent of a cure site monomer.

15. An intermediate transfer member in accordance with claim 12, wherein said fluoropolymer comprises a filler dispersed therein, said filler selected from the group consisting of carbon black, graphite, fluorinated carbon and metal oxides.

16. An intermediate transfer member in accordance with claim 1, further comprising an outer release layer positioned on said conformable layer.

17. An intermediate transfer member in accordance with claim 16, wherein said outer release layer comprises silicone rubber.

18. An intermediate transfer member in accordance with claim 16, wherein said release layer has a thickness of from about 1 to about 10 mil.

19. An intermediate transfer member in accordance with claim 1, wherein said conformable layer has a hardness of from about 30 to about 80 shore A.

20. An intermediate transfer belt for transferring a liquid image having at least a liquid carrier with toner particles dispersed therein from a member to a substrate, comprising a fluorinated carbon filled polyimide substrate, and having thereon a fluoroelastomer intermediate layer, and positioned thereon an outer silicone rubber release layer.

21. An apparatus for forming images on a recording medium comprising:

a charge-retentive surface to receive an electrostatic latent image thereon;

a development component to apply toner to said charge-retentive surface to develop said electrostatic latent and to form a developed image on said charge retentive surface;

an intermediate transfer member to transfer the developed image from said charge retentive surface to a substrate, wherein said intermediate transfer member comprises a fluorinated carbon filled polyimide layer and a conformable layer positioned on said fluorinated carbon filled substrate; and a fixing component.

* * * * *